US011103986B2

(12) United States Patent
Bauer

(10) Patent No.: US 11,103,986 B2
(45) Date of Patent: Aug. 31, 2021

(54) PNEUMATIC NAIL GUN WITH SAFETY CONTROL CHAMBER

(71) Applicant: Joh. Friedrich Behrens AG, Ahrensburg (DE)

(72) Inventor: Joachim Bauer, Bad Oldesloe (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 145 days.

(21) Appl. No.: 16/310,006

(22) PCT Filed: May 15, 2017

(86) PCT No.: PCT/EP2017/061603
§ 371 (c)(1),
(2) Date: Dec. 14, 2018

(87) PCT Pub. No.: WO2017/215860
PCT Pub. Date: Dec. 21, 2017

(65) Prior Publication Data

US 2019/0134795 A1 May 9, 2019

(30) Foreign Application Priority Data

Jun. 15, 2016 (EP) ..... 16174533

(51) Int. Cl.
*B25C 1/00* (2006.01)
*B25C 1/04* (2006.01)

(52) U.S. Cl.
CPC ..... *B25C 1/008* (2013.01); *B25C 1/043* (2013.01); *B25C 1/047* (2013.01)

(58) Field of Classification Search
CPC ..... B25C 1/008; B25C 1/043; B25C 1/047
(Continued)

(56) References Cited

U.S. PATENT DOCUMENTS 3,552,270 A * 1/1971 Lange ..... B25C 1/043 91/291
4,509,668 A * 4/1985 Klaus ..... B25C 1/008 227/130

(Continued)

FOREIGN PATENT DOCUMENTS

DE 3142237 A1 5/1983
DE 102013106657 A1 1/2015

(Continued)

OTHER PUBLICATIONS

PCT/EP2017/061603; filed May 15, 2017; Joh. Friedrich Behrens AG; English Translation of the International Preliminary Report on Patentability; dated Dec. 27, 2018 (6 pages).

*Primary Examiner* — Robert F Long
*Assistant Examiner* — Xavier A Madison
(74) *Attorney, Agent, or Firm* — Barclay Damon LLP

(57) ABSTRACT

A pneumatic nail gun comprises a working piston connected to a driving ram that is configured to drive in a fastening means and is pressurized by air when a driving process is initiated. A hand-operated trigger and a contact sensor. Simultaneous actuation of the hand-operated trigger and contact sensor activates a first control valve and initiates the driving process if the pressure in a safety control chamber is above a given pressure threshold. A second control valve is configured to be activated upon actuation of the trigger. The safety control chamber is continuously de-aerated via a throttle and is separated from a pressurized casing interior when the second control valve is activated.

9 Claims, 6 Drawing Sheets

(58) Field of Classification Search
USPC ..... 227/8
See application file for complete search history.

(56) References Cited

U.S. PATENT DOCUMENTS

| | | | | | |
|---|---|---|---|---|---|
| 5,370,037 | A * | 12/1994 | Bauer | B25C 1/042 | 91/236 |
| 5,522,532 | A * | 6/1996 | Chen | B25C 1/008 | 227/130 |
| 9,782,879 | B2 * | 10/2017 | Bauer | B25C 1/04 | |
| 2010/0252608 | A1 * | 10/2010 | Lai | B25C 1/047 | 227/8 |
| 2010/0301091 | A1 * | 12/2010 | Liang | B25C 1/008 | 227/8 |

FOREIGN PATENT DOCUMENTS

| | | | |
|---|---|---|---|
| EP | 2161103 | A1 | 3/2010 |
| EP | 2767365 | A1 | 8/2014 |

* cited by examiner

PNEUMATIC NAIL GUN WITH SAFETY CONTROL CHAMBER

CROSS REFERENCE TO RELATED INVENTION

This application is a national stage application pursuant to 35 U.S.C. § 371 of International Application No. PCT/EP2017/061603, filed on May 15, 2017, which claims priority to, and benefit of, European Patent Application No. 16 174 533.6, filed Jun. 15, 2016, the entire contents of which are hereby incorporated by reference.

BACKGROUND

The invention relates to a pneumatic nail gun with a working piston that is connected to a driving tappet for driving in a fastening means and to which compressed air is applied upon triggering a driving process, a triggering apparatus that has a manually-actuatable trigger and a contact sensor, wherein a joint actuation of the trigger and contact sensor controls a first control valve and triggers a driving process if the pressure in a safety control chamber lies above a given pressure threshold, and a second control valve that is controlled upon actuating the trigger independent of actuating the contact sensor.

The contact sensor is a mechanical component which is usually held by a spring in a position projecting beyond an outlet tool of the pneumatic nail gun. If the pneumatic nail gun is placed on a workpiece, the contact sensor is displaced against the force of the spring until the discharge tool lies on, or nearly on, the workpiece. Only when the contact sensor has been actuated in this manner can a driving process be triggered. Consequently, the known pneumatic nail guns offer significantly improved safety against unintentional triggering in comparison to devices without a contact sensor.

Pneumatic nail guns with a triggering apparatus of the described kind can be used in two different operating modes. With so-called single triggering, the pneumatic nail gun is first placed onto a workpiece which actuates the contact sensor. Subsequently, the trigger is actuated manually and, as a result, an individual driving process is triggered.

With so-called contact triggering, also denoted as "touching", the user already holds the trigger pressed down while placing the pneumatic nail gun onto the workpiece. When the workpiece is touched, the contact sensor is actuated and thereby triggers a driving process. The pneumatic nail gun may be placed repeatedly in rapid succession which permits a very rapid operation, in particular when a plurality of fastening means must be driven in for sufficient fastening, and the set requirements for the positional accuracy thereof are only minimal.

In specific situations, however, an increased risk of injury arises from the contact triggering method. If the user holds the manually-actuated trigger pressed down, for example, not only when he wishes to position the pneumatic nail gun onto one and the same workpiece at a spacing of a few centimeters from the previously driven-in fastening means, but also when he changes to a different workpiece arranged at a distance therefrom, a driving process may be triggered by an unintentional contact of an object or body part with the contact sensor. For example, it may lead to accidents when a user (by ignoring important safety rules) climbs onto a ladder with the pneumatic nail gun, while holding the trigger pressed down, and unintentionally brushes his leg with the contact sensor.

The pneumatic nail gun known from EP 2 767 365 A1 has a safety control chamber, the pressure of which acts on a locking piston and prevents a driving process from being triggered when the locking piston is in a certain position. The safety control chamber is deaerated or aerated by the second control valve and a throttle. Consequently after the trigger is actuated, contact triggering is only possible for a short time, i.e., until the pressure passes a set threshold in the safety control chamber. Then the pneumatic nail gun is locked until the trigger is released and the pressure in the safety control chamber reaches its initial state again.

BRIEF SUMMARY OF THE INVENTION

Against this background, it is the object of the invention to provide a pneumatic nail gun with an improved safety mechanism.

A pneumatic nail gun comprises a working piston which is connected to a driving tappet or ram for driving in a fastening means and which is subjected to compressed air when a driving process is initiated or triggered, a triggering apparatus that has a manually actuatable trigger and a contact sensor, wherein a joint actuation of the trigger and contact sensor controls a first control valve and triggers a driving process if the pressure in a safety control chamber lies above a given pressure threshold, a second control valve that is controlled upon actuating the trigger independent of actuating the contact sensor, wherein the safety control chamber is continuously deaerated by a throttle independent of the position of the second control valve and is separated from a housing interior that is under pressure when the second control valve is controlled.

The pneumatic nail gun is used for driving in fastening means, such as nails, tacks or staples. To this end, the pneumatic nail gun may have a magazine for the fastening means, in each case a fastening means being supplied therefrom to a seat of an outlet tool of the pneumatic nail gun.

Both the driving as well as the controlling of the pneumatic nail gun can be entirely pneumatic; a supply with electrical energy is therefore unnecessary. "Deaerating" always means that a connection is established to a depressurized space, in particular to external air. "Aerating" always means that a connection is established to a space that conducts compressed air.

When triggering a driving process, a working piston of the pneumatic nail gun is subjected to compressed air. In this case, the working piston drives a driving tappet which is connected to the working piston. The driving tappet strikes a rear end of the fastening means in the seat of the outlet tool and drives the fastening means into the workpiece.

The triggering device has a manually-actuatable trigger, such as in the form of a toggle switch or sliding switch, and a contact sensor. The contact sensor may be a mechanical component which protrudes over the front end of the outlet tool and is held in this position by a spring until the pneumatic nail gun is placed onto a workpiece. Then the contact sensor is displaced opposite the direction of the spring force and opposite the driving direction. If this actuation of the contact sensor occurs together with an actuation of the trigger, a first control valve is controlled which can trigger a driving process.

When the trigger and contact sensor are actuated together, the first control valve is controlled. If only either the manually-actuated trigger or the contact sensor is actuated, the first control valve is not controlled. For a joint actuation of the trigger and contact sensor, it is sufficient if both the trigger as well as the contact sensor are both simultaneously in an actuated state at a certain point in time. This can be achieved on the one hand by a simultaneous actuation as well as in any sequence. For example, as is typical for a single triggering, first the contact sensor can be actuated and then the manually-actuated trigger. In contrast in contact triggering mode, first the manually-actuated trigger and then the contact sensor can be actuated.

Controlling the first control valve can be achieved by mechanically coupling the manually-actuatable trigger and the contact sensor. For example, a control pin of the first control valve can only be displaced in the event of a joint actuation of the trigger and contact sensor, and the first control valve can be controlled thereby.

The control of the first control valve triggers a driving process if the pressure in the safety control chamber lies above a given pressure threshold. Otherwise, a driving process is not triggered when the first control valve is controlled.

The second control valve is controlled upon actuating the manually-actuatable trigger independent of actuating the contact sensor. The second control valve is therefore controlled upon each actuation of the trigger. For this purpose, for example a control pin of the second control valve can be arranged such that it is displaced from its home position upon each actuation of the trigger.

In the invention, the safety control chamber is continuously deaerated by a throttle independent of the position of the second control valve and is separated from a housing interior that is under pressure when the second control valve is controlled. In an initial state of the pneumatic nail gun, the safety control chamber is connected to the housing interior under pressure. "Initial state" always means a state in which the pneumatic nail gun is connected to a compressed air supply, and neither the contact sensor nor the trigger is actuated. At the same time, the safety control chamber is continuously deaerated via the throttle. If the connection between the safety control chamber and the housing interior under pressure is disconnected by controlling the second control valve, the airstream escaping via the throttle is no longer compensated by air flowing outward from the housing interior into the safety control chamber, and the pressure in the safety control chamber falls below the given pressure threshold within a certain time so that further triggerings are no longer possible.

The continual air loss via the throttle that appears disadvantageous at first glance has proven to be particularly advantageous in practice because it is inconsequential with regard to the compressed air consumption and causes an operating noise. In this regard, the throttle, or respectively a line connecting the throttle to the outside air, can in particular be arranged, and an airflow escaping via the throttle can be set so that the air escaping through the throttle causes a perceptible operating noise to a user.

This operating noise indicates proper functioning of the safety apparatus and the readiness of the unit to shoot: If a malfunction occurs, for example if the throttle becomes contaminated, the operating noise changes or stops. If the operating noise stops when the trigger is actuated due to a loss of pressure in the safety control chamber, this indicates to a user that additional driving processes can only be triggered after the pressure in the safety control chamber is reestablished by releasing the trigger.

In one embodiment, the safety control chamber is deaerated via the second control valve when the trigger is not actuated. To accomplish this, a direct connection is established via the second control valve between the safety control chamber and a housing interior under pressure which causes instantaneous aeration of the safety control chamber. The pneumatic nail gun is therefore in a ready-to-shoot initial state again within a very brief time after the trigger is released.

In one embodiment, the throttle is connected to a line that connects the second control valve to the safety control chamber. In principle, the throttle can be in any type of connection between the safety control chamber and outside air. The arrangement on the line provided to aerate the safety control chamber via the second control valve enables a particularly simple, compact structure.

In one embodiment, the first control valve, the second control valve and the throttle are combined in one valve block. This measure also promotes a simple and compact structure.

In one embodiment, the pressure in the safety control chamber acts on a safety valve piston of a safety valve that blocks a line which aerates or deaerates when the first control valve is controlled. Depending on the pressure in the safety control chamber, a line serving to trigger a driving process is blocked so that triggering is prevented. For this, the safety control chamber can be connected via a line to a working volume of the safety valve, or it can form this working volume. In particular, the pressure in the safety control chamber can press the safety valve piston in a direction that corresponds to an open position of the safety valve.

In one embodiment, a spring pretensions the safety valve piston against the pressure in the safety control chamber. The position of the safety valve therefore results from the interplay between the spring force and the force exerted by the pressure in the safety control chamber on the safety valve piston. By adjusting the spring to the effective cross-section of the safety valve piston, the pressure in the control chamber up to which the safety valve remains in its open position can therefore be precisely specified.

In one embodiment, the pneumatic nail gun has a pilot valve with a control piston, wherein the control piston and the safety valve piston are arranged along a common longitudinal axis. The pilot valve serves to control a main valve of the pneumatic nail gun by means of which the working piston is aerated. The aforementioned arrangement of the control piston and safety valve piston enables a particularly easy-to-produce, compact design of the pneumatic nail gun.

In one embodiment, the control piston and the safety valve piston are arranged on the side of the working cylinder. In particular, the common axis of the control piston and safety valve piston are oriented parallel to a longitudinal axis of the working cylinder. These features also promote easy production and a compact design of the pneumatic nail gun.

In one embodiment, an opening cross-section of the throttle is dimensioned such that when the pneumatic nail gun is operated at an operating pressure provided therefor, the pressure in the safety control chamber falls below the given pressure threshold over a period of 0.1 s to 10 s after the second control valve is controlled. In particular, the pressure threshold can be fallen short of in a period between 1 s and 5 s after controlling the second control valve, for example after approximately 4 s. The opening cross-section of the throttle can be adjustable so that the period can be regulated individually. Preferably, this regulation is only done once by the manufacturer of the pneumatic nail gun and can only be changed by impermissible manipulation by a user. In each case, the pneumatic nail gun is blocked in a timely manner, in order to prevent a driving process resulting from unintentional actuation of the contact sensor in many typical situations of use.

In one embodiment, the pneumatic nail gun has a non-return valve by means of which the safety control chamber is aerated when a driving process is triggered. When a driving process is triggered, the initial state is restored with respect to the pressure in the safety control chamber. This can occur very quickly. If after the driving process the trigger is still pressed, the pressure in the safety control chamber approaches the pressure threshold again in the manner described above that is fallen short of after the given period. Until then, further triggering is possible at any time by the actuation of the contact sensor so that the pneumatic nail gun is suitable for sequential driving processes in the contact triggering method.

BRIEF DESCRIPTION OF THE DRAWINGS

The invention is explained in greater detail below based on an exemplary embodiment shown in figures. In the following.

DETAILED DESCRIPTION OF THE INVENTION

Figure 1:
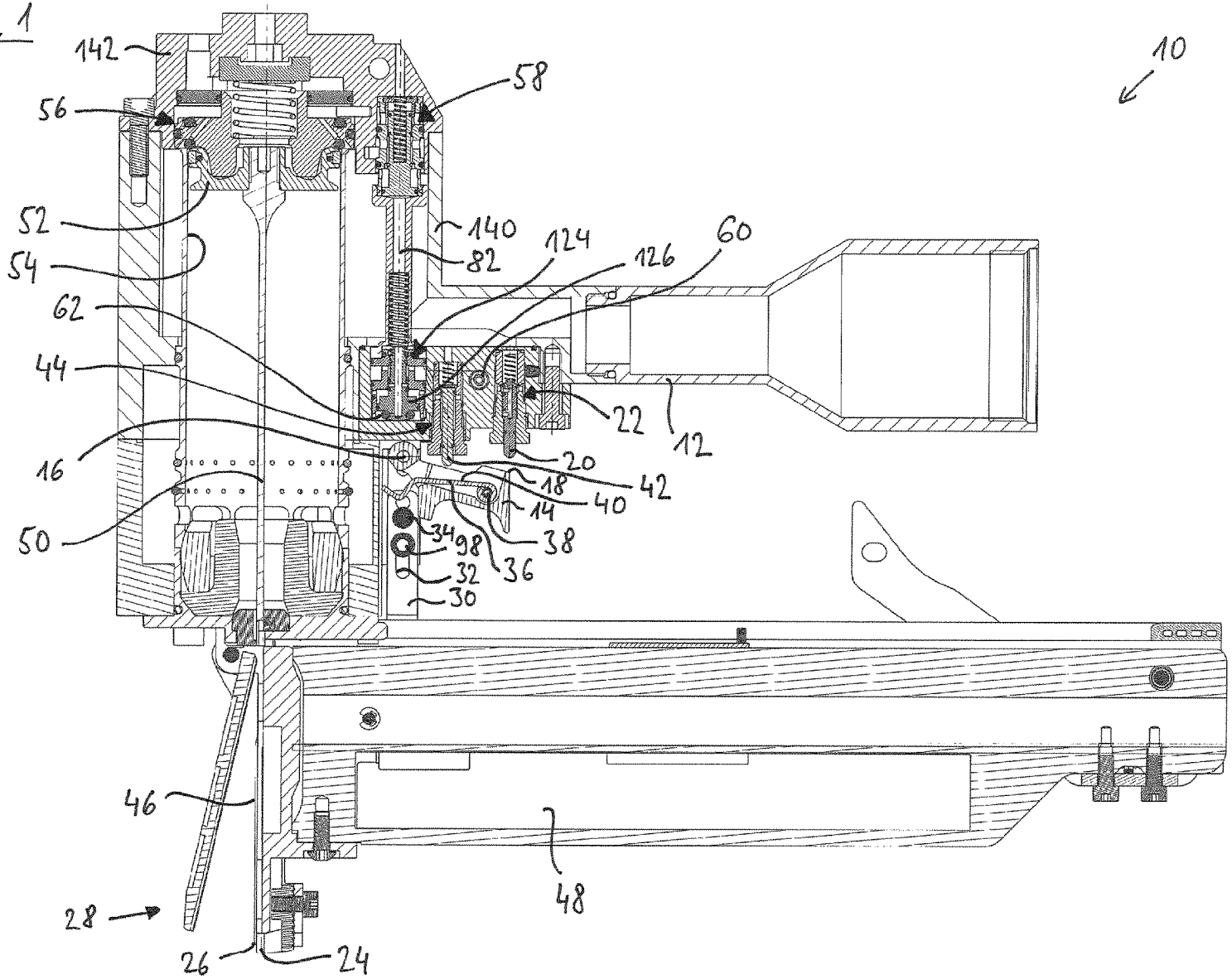
FIG. 1 shows a pneumatic nail gun according to the invention in a partially sectional view.

First, the most important elements of the compressed air gun 10 will be addressed, partially in the form of an overview, with reference to FIG. 1. The pneumatic nail gun 10 has a handle 12 that is attached to a lower housing part 140 which is closed at the top by a housing cap 142.

The manually-actuated trigger 14 is pivotably mounted around a pivot axis 16 on the housing of the pneumatic nail gun 10 and arranged such that it can be actuated comfortably with the index finger by a user who holds the pneumatic nail gun 10 by the handle 12. Upon this actuation, a switching surface 18 arranged on the top side of the trigger 14 comes into contact with a switching pin 20 of a second control valve 22, moves the switching pin 20 upward, and thereby controls the second control valve 22. Since the control of the second control valve 22 is immediately effectuated by the switching surface 18 securely arranged on the trigger 14, it is independent of the actuation of a contact sensor 24.

The contact sensor 24 protrudes downwardly over the mouth 26 of an outlet tool 28 by a few millimeters. If the pneumatic nail gun 10 is placed onto a workpiece, the contact sensor 24 is displaced upward against the force of a spring (not shown) until it abuts the mouth 26 flush or projects just slightly above the mouth 26. The contact sensor 24 is mechanically coupled to a force transmission element 30 which also moves upward when the contact sensor 24 moves. The force transmission element 30 is movably guided on the housing of the pneumatic nail gun 10 and has a slot 32 through which a guide pin 98 is guided.

Upon an actuation of the contact sensor 24, the force transmission element 30 is displaced upward from the initial position drawn, and in so doing entrains the free end of a lever 36 by a contact pin 34 fastened to the force transmission element 30, whereby the fixed end of the lever 36 is pivotably articulated about a pivot axis 38 in the interior of the trigger 14 and close to its free end. The lever 36 is then arranged approximately parallel to a longitudinal direction of the trigger 14, and its top side functions as a switching surface 40 which, given the joint actuation of the contact sensor 24 and the trigger 14, displaces a switching pin 42 of a first control valve 44 upward and thus controls the first control valve 44.

The outlet tool 28 has a receiver 46, to which a fastening means is fed from a magazine 48. From this position inside the receiver 46, the fastening means—for example a nail, a tack or a staple—is driven in by a driving tappet 50 which is connected to a working piston 52 of the pneumatic nail gun 10. To this end, the working piston 52 is guided in a working cylinder 54. Above the working cylinder 54 and sealingly closing this working cylinder, a main valve 56 is arranged, to the right thereof there being a pilot valve 58 which controls the main valve 56. Details of these elements as well as the associated function of the device will be explained with reference to the enlargement of a section in FIG. 2.

Figure 2:
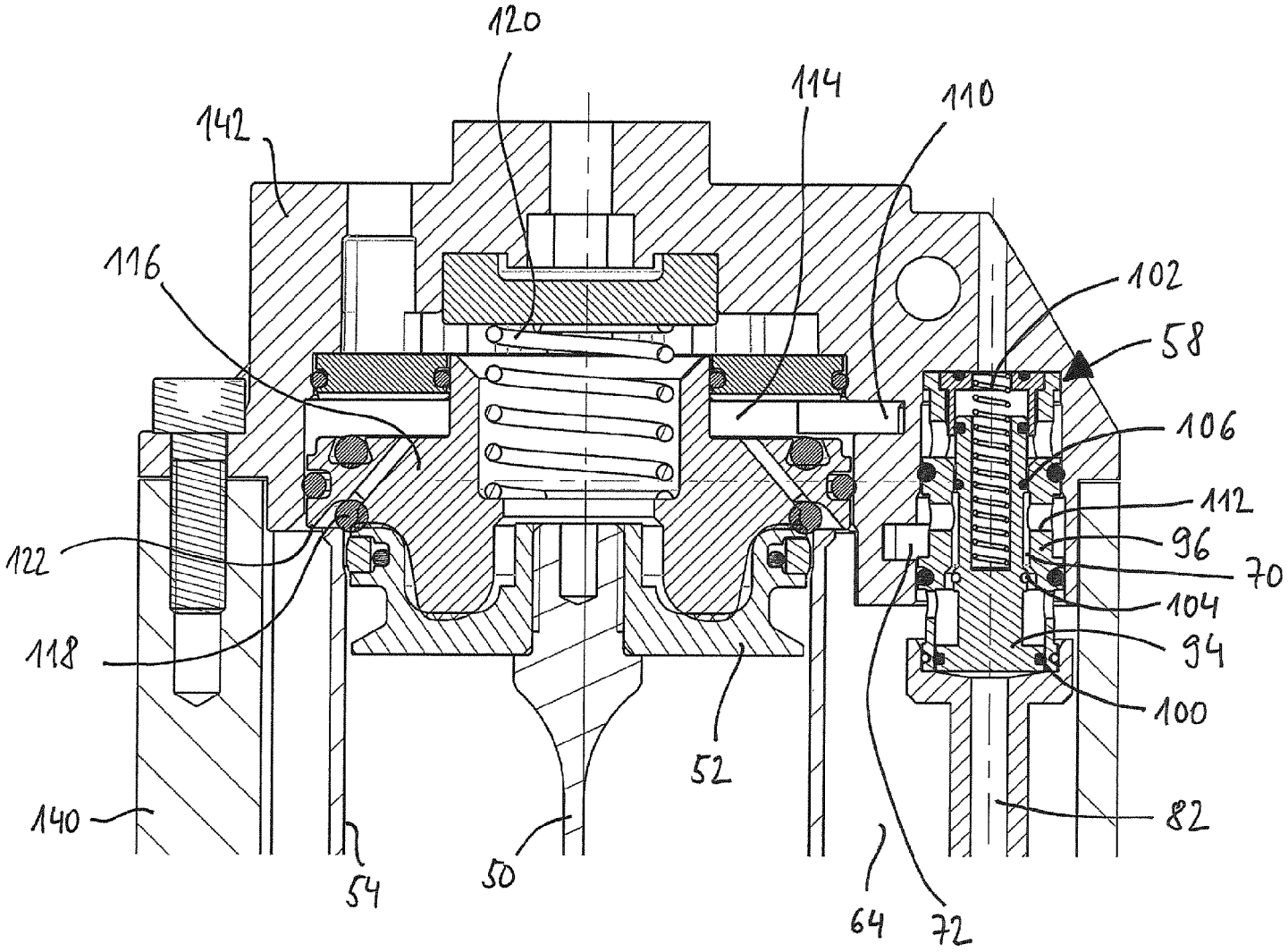
FIG. 2 shows an enlarged view of a detail with the main valve and pilot valve of FIG. 1.

The pilot valve 58 is best discernible in FIG. 2. It has a control piston 94 which is guided in a guide sleeve 96. The lower end of the control piston 94 is sealed by a lower O-ring 100 relative to the guide sleeve 96. In the initial state of the pneumatic nail gun 10, a first control line 82 which is connected to a working volume of the pilot valve 58 is deaerated, and the control piston 94 is located in the shown lower position. In this position, the control piston is retained by the force of a spring 102.

The control piston 94 has, in addition to the lower O-ring 100, a central O-ring 104 and an upper O-ring 106. In the shown lower position of the control piston 94, the upper O-ring 106 seals the control piston 94 against the guide sleeve 96 and closes a connection to a deaeration opening (not shown) connected to the external air. The central O-ring 104 is not sealed, so that a main control line 110 is connected to the housing interior 64 via a radial hole 112 in the guide sleeve 96 and the annular gap 70 between the control piston 94 and guide sleeve 96 running past the central O-ring 104. The main control line 110 is connected via a connection, which is invisible in the sectional plane shown, to the space 72 that terminates in the radial hole 112. The housing interior 64 in the initial state of the pneumatic nail gun 10 is aerated, i.e. connected to a compressed air connection (not shown) and at operating pressure.

The main control line 110 is connected to a space 114 above a main valve actuating member 116 of the main valve 56 such that the main valve actuating member 116 is subjected to a downward force which seals the upper edge of the working cylinder 54 by means of an O-ring 118 against the housing interior 64. Additionally, the main valve actuating member 116 is acted upon by a spring 120 with a force in the direction of the position shown, closing the working cylinder 54.

A driving process is triggered by aerating the first control line 82 in that the control piston 94 is displaced upward so that the central O-ring 104 creates a seal and the upper O-ring 106 releases the seal. This blocks the connection of the main control line 110 to the housing interior 64, and a connection between the main control line 110 and a deaeration opening (not shown) is established. The space 114 above the main valve actuating member 116 is deaerated via the deaeration opening, and the main valve actuating member 116 is displaced upward counter to the force of the spring 120 by the pressure which is present on its lower outer annular surface 122 and which prevails in the housing interior 64. As a result, compressed air flows out of the housing interior 64 into the working cylinder 54 above the working piston 52 and drives the working piston 52 downward. With this downward movement, the driving tappet 50 connected to the working piston 52 drives in a fastening means.

Below the pilot valve 58 in FIG. 1, there is a safety valve 124 with a safety valve piston 126 that interacts with a safety control chamber 62 and a throttle 60. Details of these elements as well as the associated function of the device will be explained with reference to FIGS. 3 to 6.

Figure 3:
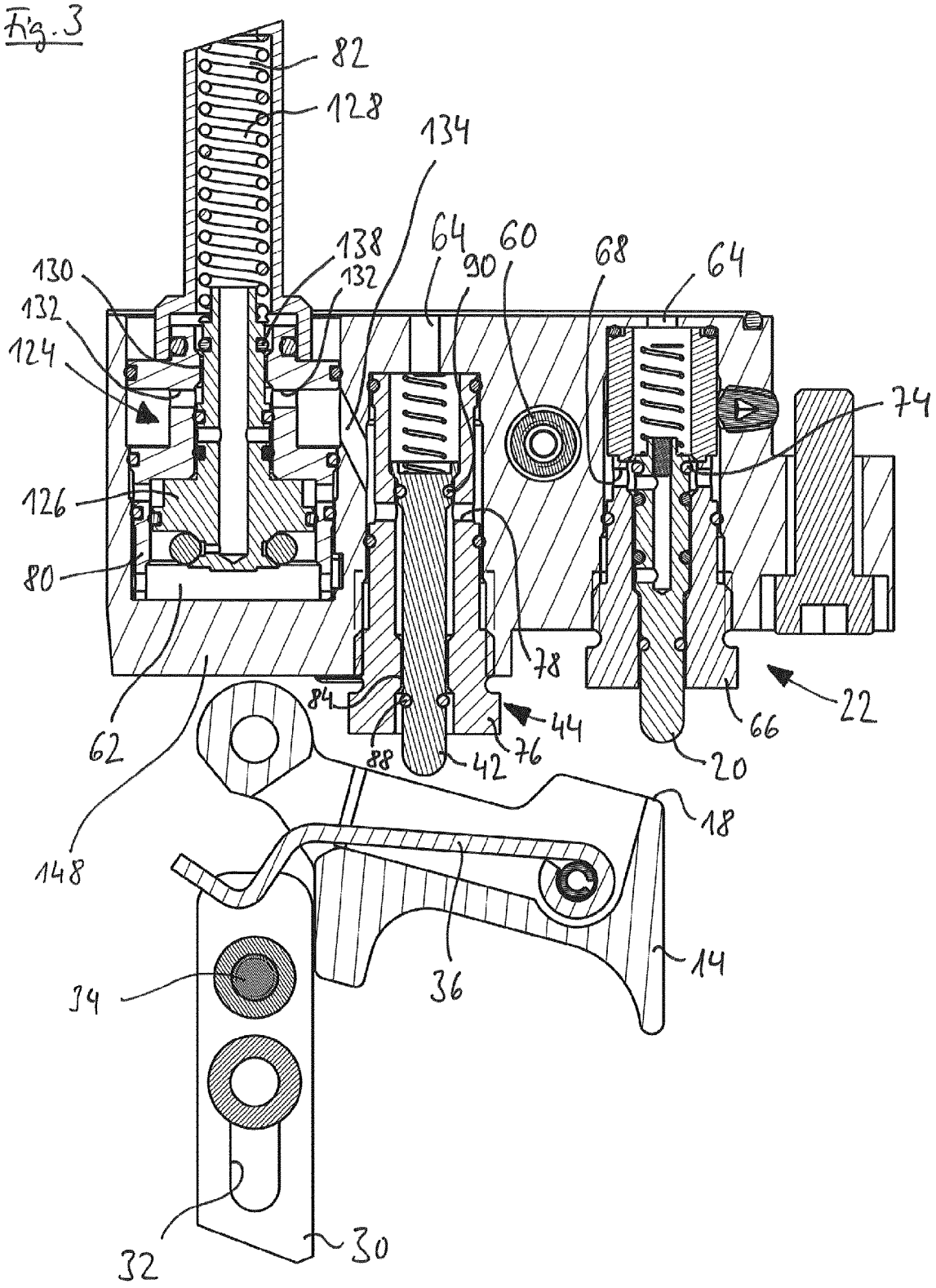
FIG. 3 illustrates an enlarged view of selected elements from FIG. 1 in an operating state.

The manually-actuatable trigger 14 with the lever 36 mounted therein and the switching surface 18 is easily discernible in FIG. 3. The switching pin 20 of the second control valve 22 is guided in a sleeve 66 of the second control valve 22 that is inserted in the housing against which it is sealed. A second control line that cannot be seen in the sectional planes in the figures connects a radial hole 68 in the sleeve 66 to the safety control chamber 62. A top O-ring 74 of the second control valve 22 does not provide a seal so that the radial hole 68 is connected to the housing interior 64. The safety control chamber 62 is therefore aerated in the initial state shown in FIG. 3.

Moreover, a throttle 60 is connected to the second control line (not shown) and connects the second control line, and hence the safety control chamber 62, to outside air. In the initial state, air continuously flows outward through the throttle 60 which causes an operating noise that is perceptible to a user.

The pressure in the safety control chamber 62 acts on the bottom side of the safety valve piston 126 and holds the safety valve piston 126 in the shown top position against the force of a spring 128. The safety valve piston 126 is guided in a sleeve 80 and has a top O-ring 138 that does not provide a seal in the shown position. Consequently, the first control line 82 within which the spring 128 is arranged in FIG. 3 is connected by an annular gap 130 and a radial hole 132 in the sleeve 80 to an obliquely arranged third control line 134.

The switching pin 42 of the first control valve 44 is guided in a sleeve 76 that has a radial hole 78 connected to the third control line 134. A top O-ring 90 on the valve pin 42 seals against the sleeve 76; a bottom O-ring 88 on the valve pin 42 does not provide a seal. Consequently, the radial hole 78 and hence the third control line 134 are aerated through an annular gap 84. In the shown initial position, the housing interior 64 is also separated from the radial hole 78 by the top O-ring 90.

The first control valve 44, the second control valve 22 and the throttle 60 are combined in a common valve block 148.

Figure 4:
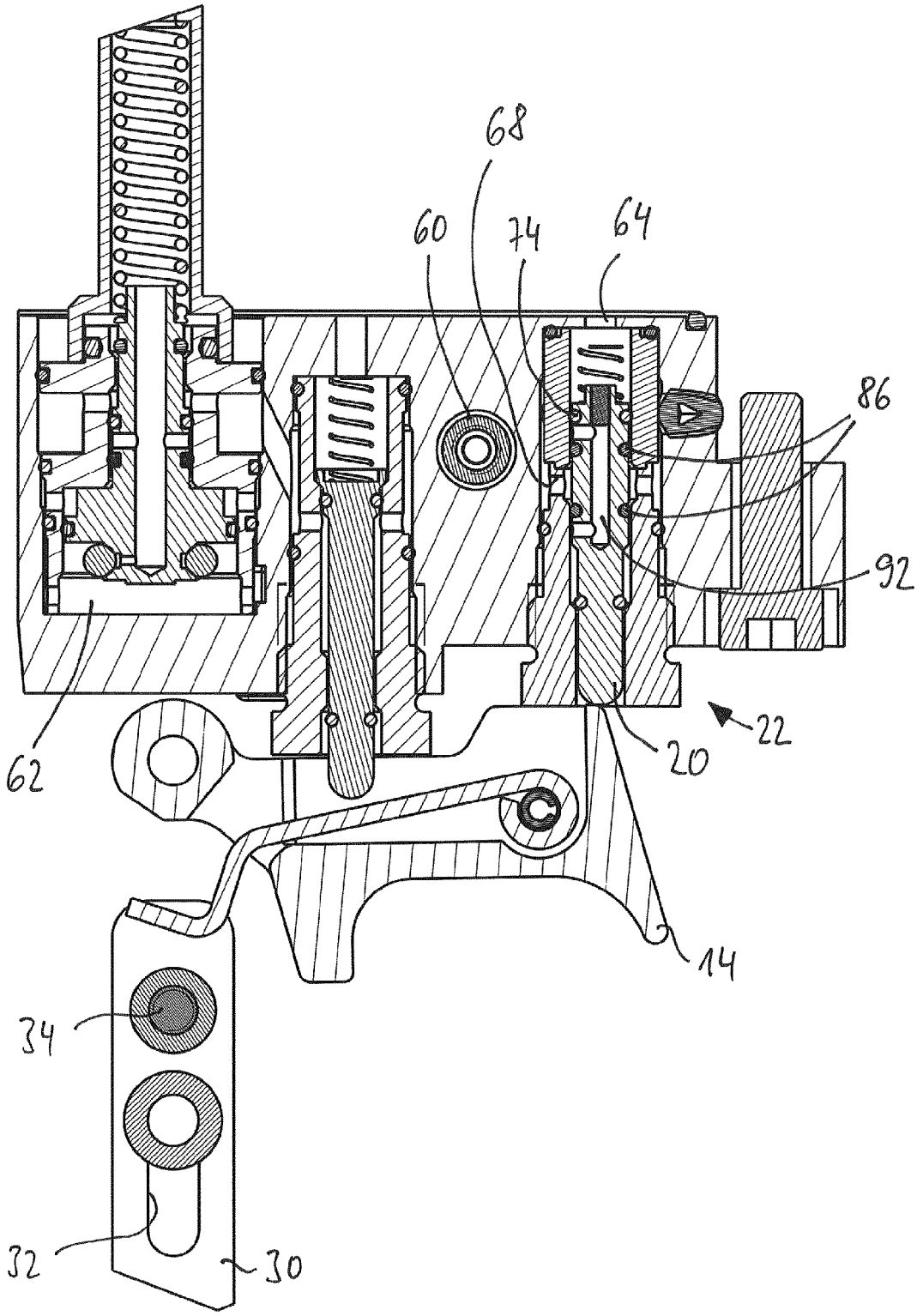
FIG. 4 illustrates an enlarged view of selected elements from FIG. 1 in an operating state.

FIG. 4 shows the arrangement from FIG. 3 directly after the actuation of the trigger 14. The control pin 20 is located in a top position, and the second control valve 22 blocks the connection between the housing interior 64 and the second control line (not shown) because the top O-ring 74 seals against the sleeve 66. This blocks the inflow of air into the safety control chamber 62, and the safety control chamber 62 is slowly deaerated through the throttle 60.

As an additional safety measure, the second control valve 22 has two additional O-rings 86 that both seal the control pin 20 against sleeve 66 in the two end positions of the control pin 20. The chambers outside of the two additional O-rings 86 are connected to each other by a bypass line 92 running in the interior of the control pin 20. The bypass line 92 has two radial holes and an axial hole running therebetween. The effect of this safety measure is that air flowing between the control pin 20 and sleeve 66 when there is a leak in the top O-ring 74 in the top end position cannot reach the safety control chamber 62 through the radial hole 68 but is instead guided to the outside through the bypass line 92.

Figure 5:
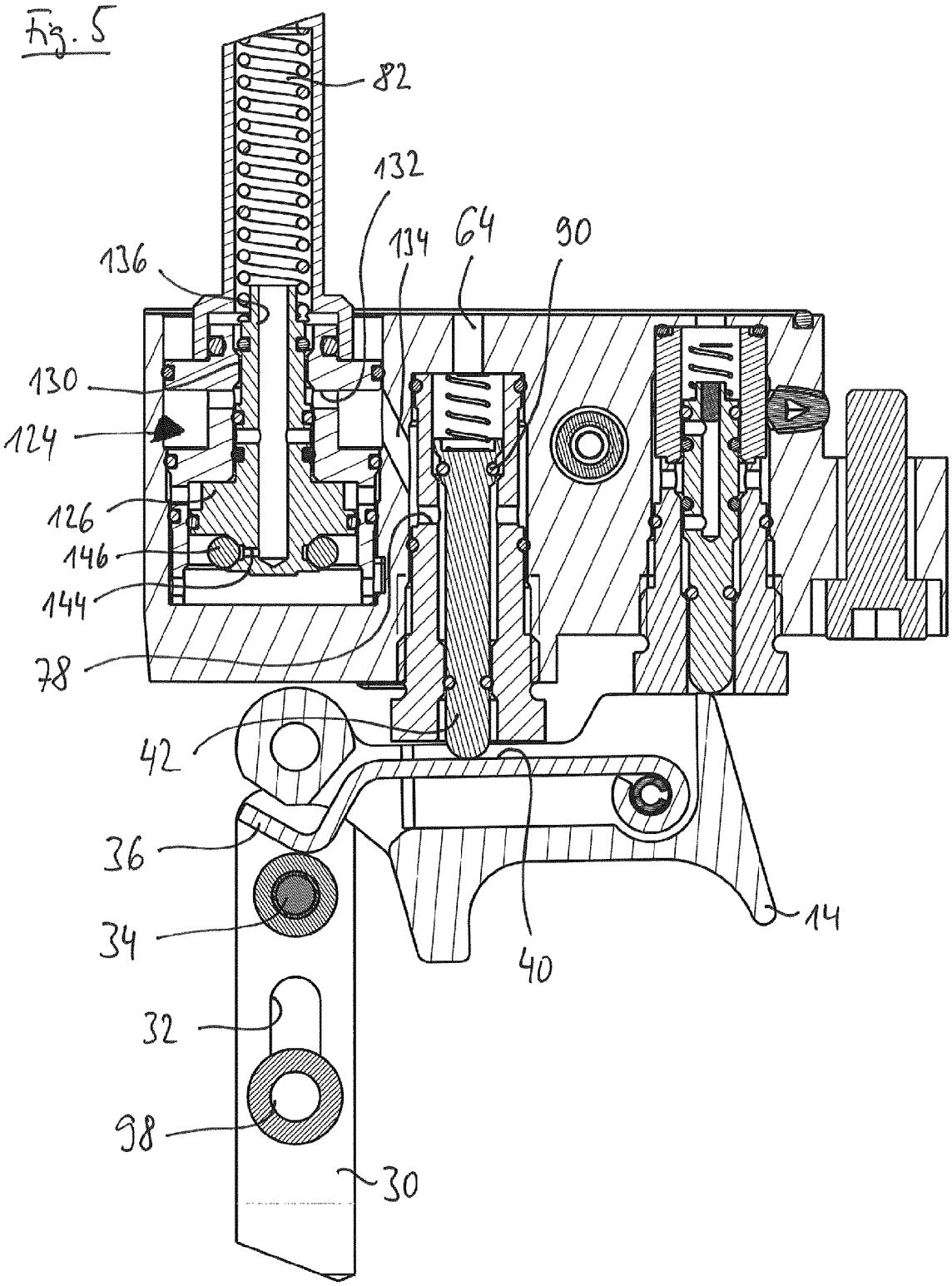
FIG. 5 illustrates an enlarged view of selected elements from FIG. 1 in an operating state.

If, starting from the state from FIG. 4, the contact sensor 24 is actuated, the position shown in FIG. 5 results. The contact pin 34 follows the upward movement of the force transmission element 30 and the contact sensor 24 so that the switching surface 40 actuates the control pin 42 of the first control valve 44. Consequently, the top O-ring 90 stops providing a seal, and the pressure from the housing interior 64 passes through the radial hole 78 and the third control line 134 to the safety valve 124. Since the safety valve piston 126 is in its top position, i.e., the safety valve 124 is in an open position, the air flows through the radial hole 132 and the annular gap 130 further to the first control line 82. A driving process is triggered as explained in conjunction with FIG. 2.

Moreover, the aeration of the first control line 82 also has the effect that, through an axial hole 136 and a radial hole 144 in the safety valve piston 126, air reaches the inside of an O-ring 146 which is inserted in a peripheral groove in the control piston 126 and forms a non-return valve that extends into the safety control chamber 62. The non-return valve opens so that the safety control chamber 62 is aerated as a result of the driving process. The time within which the additional driving processes are enabled by contact triggering starts to run again.

Figure 6:
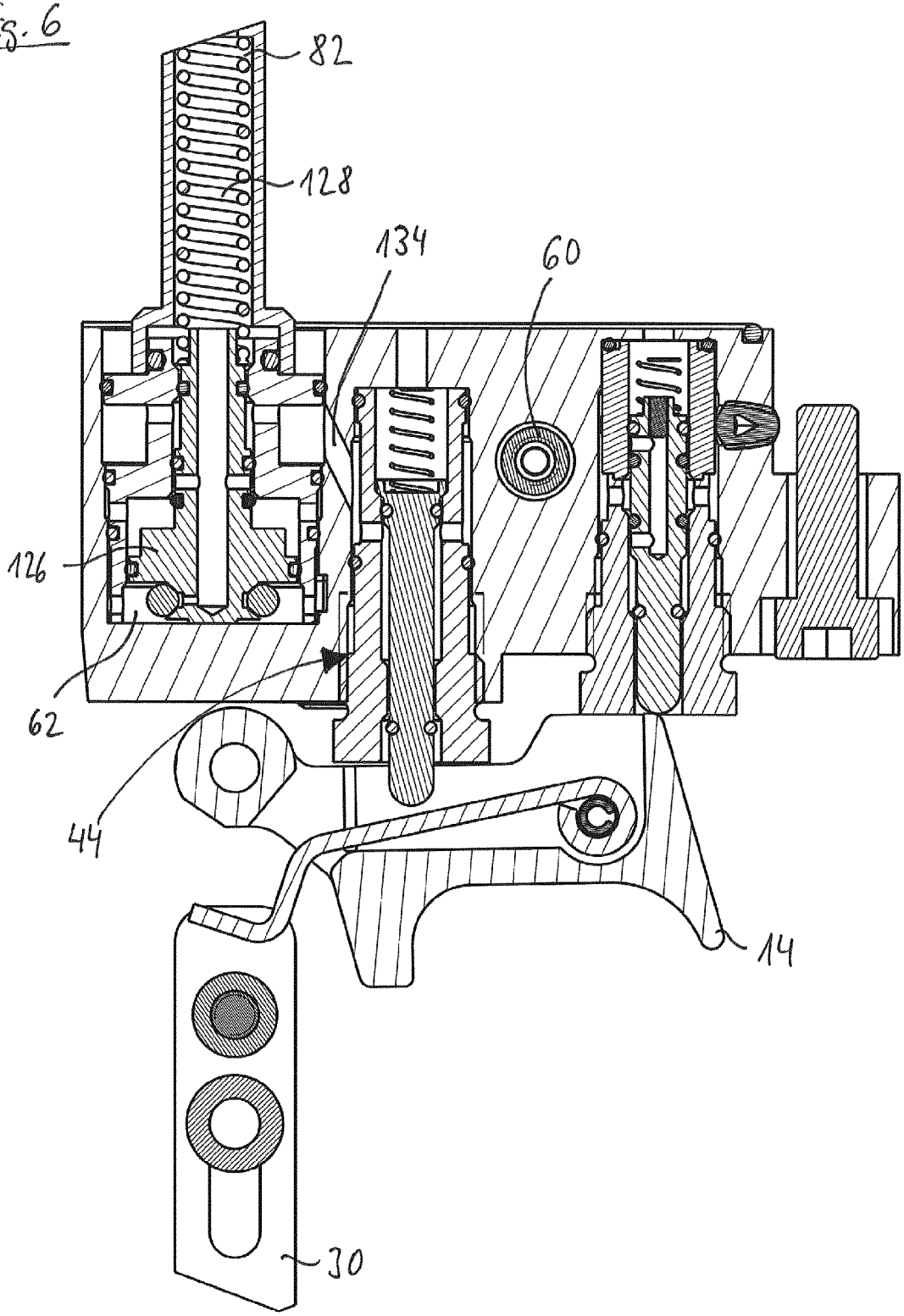
FIG. 6 illustrates an enlarged view of selected elements from FIG. 1 in an operating state.

FIG. 6 shows a locked state of the pneumatic nail gun 10 that automatically results after a certain time of inactivity starting from FIG. 4, i.e., when the trigger 14 is actuated, for example after about 4 s. During this time, the pressure in the safety control chamber 62 has decreased below the given pressure threshold due to the air escaping via the throttle 60 so that the safety control valve 126 has shifted downward under the force of the spring 128; the safety valve 124 is accordingly in a locked position in which the connection between the third control line 134 and the first control line 82 is blocked. If the contact sensor 24 is now actuated and the first control valve 44 is controlled, the aeration of the third control line 134 remains inconsequential. A driving process can only be retriggered if the pressure is reestablished in the safety control chamber 62. This can be done at any time by briefly releasing the trigger 14.

LIST OF REFERENCE NUMBERS USED

Pneumatic nail gun
Handle
Trigger
Pivot axis
Switching surface
Switching pin
Second control valve
Contact sensor
Mouth
Outlet tool
Force transmission element
Slot
Contact pin
Lever
Pivot axis
Switching surface
Switching pin
First control valve
Receiver
Magazine Driving tappet
Working piston
Working cylinder
Main valve
Pilot valve
Throttle
Safety control chamber
Housing interior
Sleeve
Radial hole
Annular gap
Space
Top O-ring
Sleeve
Radial hole
Sleeve
First control line
Annular gap
Additional O-ring
Bottom O-ring
Top O-ring
Bypass line
Control piston
Guide sleeve
Guide pin
Bottom O-ring
Spring
Middle O-ring
Top O-ring
Main control line
Radial hole
Space
Main valve actuating member
O-ring
Spring
Annular surface
Safety valve
Safety valve piston
Spring
Annular gap
Radial hole
Third control line
Axial hole
Top O-ring
Lower housing part
Housing cap
Radial hole
O-ring
Valve block

The invention claimed is:

1. A pneumatic nail gun comprising:

a working piston connected to a driving ram that is configured to drive in a fastening means and is pressurized by air when a driving process is initiated;

a hand-operated trigger and a contact sensor, wherein a simultaneous actuation of the hand-operated trigger and contact sensor activates a first control valve and initiates the driving process if pressure in a safety control chamber is above a given pressure threshold; and a second control valve, configured to be activated upon actuation of the hand-operated trigger;

wherein the safety control chamber is continuously de-aerated via a throttle and is separated from a pressurized casing interior when the second control valve is activated, and wherein the throttle comprises an opening cross section that is dimensioned such that in operation of the pneumatic nail gun with a working pressure, the pressure in the safety control chamber falls below the given pressure threshold in a period of 0.1 seconds to 10 seconds after activation of the second control valve.

2. The pneumatic nail gun according to claim 1, wherein the safety control chamber is de-aerated via the second control valve when the hand-operated trigger is in an un actuated state.

3. The pneumatic nail gun according to claim 1, wherein the throttle is connected to a line which further connects the second control valve with the safety control chamber.

4. The pneumatic nail gun according to claim 3, Wherein the first control valve, the second control valve and the throttle are combined into a valve block.

5. The pneumatic nail gun according to claim 1, wherein the pressure in the safety control chamber acts on a safety valve piston of a safety control valve, and wherein the safety valve piston is configured to close a line Which is aerated or de-aerated when the first control valve is being activated.

6. The pneumatic nail gun according to claim 5, further comprising a spring configured to preload the safety valve piston against the pressure in the safety control chamber.

7. The pneumatic nail gun according to claim 6, further comprising a pilot valve with a control piston, wherein the control piston and the safety valve piston are arranged along a common longitudinal axis.

8. The pneumatic nail gun according to claim 7, wherein the control piston and the safety valve piston are arranged laterally to the working piston.

9. The pneumatic nail gun according to claim 1, further comprising a non-return valve, configured to allow aeration of the safety control chamber when a driving process is initiated.

* * * * *